US012111090B2

(12) United States Patent
Wang et al.

(10) Patent No.: US 12,111,090 B2
(45) Date of Patent: Oct. 8, 2024

(54) CONTROL METHOD AND CONTROL APPARATUS FOR ICE MAKING OF REFRIGERATOR, AND REFRIGERATOR

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Jun Wang, Anhui (CN); Aimei Kan, Anhui (CN); Jirong Wu, Anhui (CN); Long Yao, Anhui (CN); Yunfei Zhu, Anhui (CN); Zhi Zhang, Anhui (CN); Haiyan Liu, Anhui (CN); Xiang Fang, Anhui (CN); Sizhi Guo, Anhui (CN); Wei Chen, Anhui (CN); Quanshui Li, Anhui (CN); Wenqing Kan, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 366 days.

(21) Appl. No.: 17/615,547

(22) PCT Filed: May 22, 2020

(86) PCT No.: PCT/CN2020/091767
§ 371 (c)(1),
(2) Date: Nov. 30, 2021

(87) PCT Pub. No.: WO2020/248797
PCT Pub. Date: Dec. 17, 2020

(65) Prior Publication Data

US 2022/0235989 A1 Jul. 28, 2022

(30) Foreign Application Priority Data

Jun. 11, 2019 (CN) ..... 201910503287.2

(51) Int. Cl.
*F25C 1/24* (2018.01)
*F25C 5/187* (2018.01)
*F25D 29/00* (2006.01)

(52) U.S. Cl.
CPC ..... *F25C 1/24* (2013.01); *F25C 5/187* (2013.01); *F25D 29/00* (2013.01);
(Continued)

(58) Field of Classification Search
CPC ..... F25C 1/24; F25C 5/187; F25C 2600/02; F25C 2700/02; F25C 2700/12;
(Continued)

(56) References Cited

U.S. PATENT DOCUMENTS 6,442,954 B1 9/2002 Shapiro et al.
8,499,572 B2 8/2013 Lim et al.
(Continued)

FOREIGN PATENT DOCUMENTS

CN 103292535 A 9/2013
CN 103851877 A 6/2014
(Continued)

*Primary Examiner* — Marc E Norman
(74) *Attorney, Agent, or Firm* — Seed IP Law Group LLP

(57) ABSTRACT

The present application relates to the field of ice making control for a refrigerator. Disclosed is a control method for ice making of a refrigerator, the method comprising: when an ice maker finishes ice making, detecting whether an ice storage box of the ice maker is in an ice-full state; when it is detected that the ice storage box is not in the ice-full state, controlling the ice maker to complete a first instance of ice turning; detecting again whether the ice storage box of the ice maker is in the ice-full state; and when it is detected that the ice storage box is in the ice-full state, controlling the ice
(Continued)

maker to make ice again. In this way, the utilization rate of an ice maker can be effectively improved, the ice making amount is improved, the time during which a user waits for ice making is reduced, and the user experience is improved.

12 Claims, 5 Drawing Sheets

(52) U.S. Cl.
CPC ..... *F25C 2600/02* (2013.01); *F25C 2600/04* (2013.01); *F25C 2700/02* (2013.01)

(58) Field of Classification Search
CPC ..... F25C 2600/04; F25D 2700/02; F25D 2700/04; F25D 29/00
See application file for complete search history.

(56) References Cited

U.S. PATENT DOCUMENTS

| | | | | |
|---|---|---|---|---|
| 2007/0151282 | A1* | 7/2007 | Jeong | F25C 5/08 62/353 |
| 2010/0175398 | A1 | 7/2010 | Lim et al. | |
| 2019/0331382 | A1* | 10/2019 | Saito | F25C 1/04 |
| 2020/0003470 | A1* | 1/2020 | Ishimizu | F25C 1/10 |

FOREIGN PATENT DOCUMENTS

| | | | | |
|---|---|---|---|---|
| CN | 103940184 | A | | 7/2014 |
| CN | 105882980 | A | | 8/2016 |
| CN | 107763914 | A | | 3/2018 |
| CN | 108253676 | A | | 7/2018 |
| CN | 110307692 | A | | 10/2019 |
| JP | H1054633 | A | | 2/1998 |
| JP | 2875997 | B2 | | 3/1999 |
| JP | 2010078821 | A | * | 4/2010 |
| KR | 10-2007-0078576 | A | | 8/2007 |
| KR | 100790031 | B1 | | 1/2008 |
| TW | 201635911 | A | | 10/2016 |
| WO | WO 2019042333 | A1 | | 3/2019 |

* cited by examiner

CONTROL METHOD AND CONTROL APPARATUS FOR ICE MAKING OF REFRIGERATOR, AND REFRIGERATOR

CROSS REFERENCE TO RELATED APPLICATIONS

This application claims benefits of Chinese patent application No. 201910503287.2, filed on Jun. 11, 2019, the contents of which are incorporated herein by reference.

BACKGROUND

Technical Field

This application relates to the field of ice making control of refrigerators, and in particular to a control method and device for ice making of a refrigerator, and a refrigerator.

Description of the Related Art

After completing ice making, an ice maker in a refrigerator on the market needs to perform an ice turning-over action to pour ice cubes into an ice storage box and needs to detect ice before ice turning over to detect whether the ice storage box is full of ice, if it is detected that the ice storage box has been full of the ice, ice turning over cannot be performed, or else, the ice cubes will overflow. The current ice cube tray generally allows to perform the ice turning-over action once, if ice turning over is performed in such a way, sometimes, the ice cubes still remain in the ice cube tray and cannot be completely poured into the ice storage box, thereby affecting the ice making capacity of ice making next time, and finally resulting in reduction of the total ice making capacity.

BRIEF SUMMARY

Purposes of implementations of this application are to provide a control method and device for ice making of a refrigerator, and a refrigerator to solve the problem that when an ice maker of a refrigerator in the prior art turns over ice, residual ice cubes exist to affect the ice making capacity of ice making next time to finally result in the lowering of the total ice making capacity.

In order to achieve the above-mentioned purposes, this application provides a control method for ice making of a refrigerator. The control method includes the following steps:

- detecting whether an ice storage box of an ice maker is in an ice-full state under the condition that the ice maker completes ice making;
- controlling the ice maker to perform first ice turning over under the condition of detecting that the ice storage box is not in the ice-full state;
- detecting again whether the ice storage box of the ice maker is in the ice-full state; and
- controlling the ice maker to remake ice under the condition of detecting that the ice storage box is in the ice-full state.

Optionally, the step of detecting whether the ice storage box of the ice maker is in the ice-full state again further includes:

- controlling the ice maker to perform second ice turning over under the condition of detecting that the ice storage box is not in the ice-full state; and
- controlling the ice maker to remake ice.

Optionally, the control method further includes the following steps:

- delaying a second time under the condition of firstly detecting that the ice storage box is in the ice-full state; and
- controlling the ice maker to restart first ice turning over.

Optionally, the ice maker completing ice making includes:

- controlling the ice maker to work for a first time;
- acquiring the temperature of ice cubes in an ice cube tray of the ice maker; and
- completing ice making under the condition of determining that the temperature of the ice cubes is lower than a preset temperature.

Optionally, the control method further includes the following steps:

- acquiring a duration that a door of a freezing chamber of the refrigerator is opened before the ice maker works; and
- determining the first time according to the duration.

Optionally, the control method further includes the following steps:

- acquiring an ambient temperature around the refrigerator; and
- determining the first time according to the ambient temperature and the duration.

In order to achieve the above-mentioned purposes, this application provides a control device for ice making of a refrigerator. The refrigerator includes an ice maker, and the control device includes a controller. The controller is configured to:

- detect whether an ice storage box of the ice maker is in an ice-full state under the condition that the ice maker completes ice making;
- control the ice maker to perform first ice turning over under the condition of detecting that the ice storage box is not in the ice-full state;
- detect again whether the ice storage box of the ice maker is in the ice-full state; and
- control the ice maker to remake ice under the condition of detecting that the ice storage box is in the ice-full state.

Optionally, the controller is further configured to:

- control the ice maker to perform second ice turning over under the condition of detecting that the ice storage box is not in the ice-full state; and
- control the ice maker to remake ice. Optionally, the controller is further configured to:
- delay a second time under the condition of firstly detecting that the ice storage box is in the ice-full state; and
- control the ice maker to restart first ice turning over.

Optionally, the condition that the ice maker completes ice making, the controller is configured to perform the following steps to make the ice maker completes ice making:

- controlling the ice maker to work for a first time;
- acquiring the temperature of ice cubes in an ice cube tray of the ice maker; and
- completing ice making under the condition of determining that the temperature of the ice cubes is lower than a preset temperature.

In order to achieve the above-mentioned purposes, this application provides a refrigerator. The refrigerator includes the above-mentioned control device for ice making of the refrigerator.

Through the above-mentioned technical solutions, the control method for ice making of the refrigerator in this application includes the following steps: detecting whether the ice storage box of the ice maker is in the ice-full state under the condition that the ice maker completes ice making; controlling the ice maker to complete the first ice turning-over process under the condition of detecting that the ice storage box is not in the ice-full state; detecting whether the ice storage box of the ice maker is in the ice-full state again; and controlling the ice maker to remake ice under the condition of detecting that the ice storage box is in the ice-full state. In this way, the utilization ratio of the ice maker can be effectively increased, the ice making capacity can be improved, the time that a user waits for making ice can be shortened, and the user experience can be improved.

Other features and advantages of this application will be described in detail in the subsequent specific implementations.

BRIEF DESCRIPTION OF THE SEVERAL VIEWS OF THE DRAWINGS

The accompanying drawings are provided for further understanding of this application, and constitute one part of the description. The accompanying drawings serve to explain embodiments of this application in conjunction with the following specific implementations, rather than limiting this application. In the accommodating drawings.

DETAILED DESCRIPTION

The specific implementations of this application will be described in detail below with reference to the accompanying drawings. It should be understood that the specific implementations described herein are only used for describing and explaining this application, rather than limiting this application.

It should be noted that if embodiments of this application relate to directional indications (such as upper, lower, left, right, front, rear . . . ), the directional indications are only intended to explain a relative position relation, movement conditions and the like among components in a specific posture (as shown in the accompanying drawings), and if the specific posture is changed, the directional indications are also changed accordingly.

In addition, if embodiments of this application relate to descriptions such as "first" and "second," the descriptions such as "first" and "second" may be for descriptive purposes only, and cannot be understood as indicating or implying the relative importance or implicitly indicating the number of indicated technical features. Therefore, the features defined as "first" and "second" may explicitly or implicitly include at least one of the features. In addition, technical solutions among the various embodiments can be combined with each other, but must be based on what may be achieved by those of ordinary skill in the art. When the combination of the technical solutions conflicts or cannot be achieved, such a combination of the technical solutions should be considered to be nonexistent and not within the protective scope claimed by this application.

Figure 1:
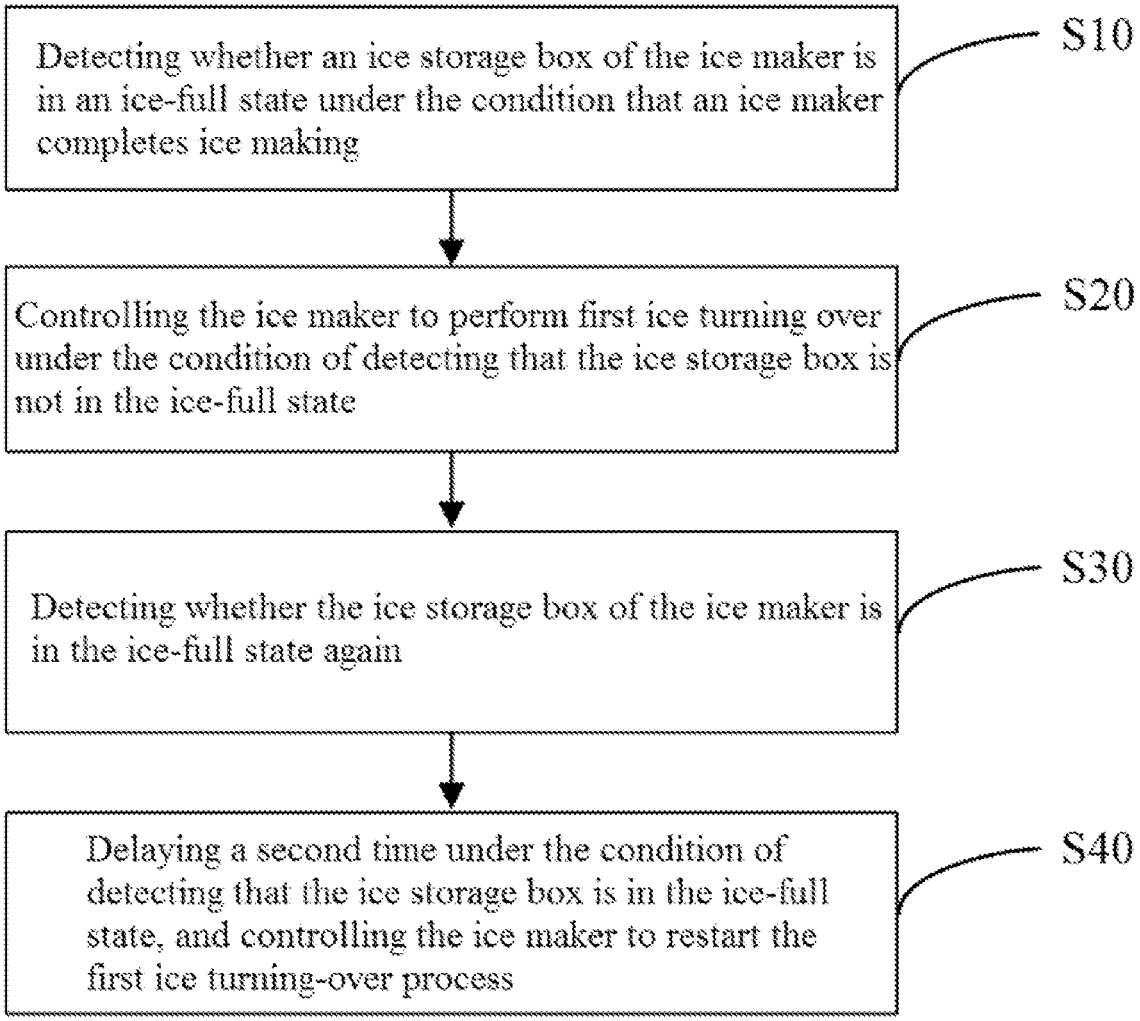
FIG. 1 is a process diagram showing a first embodiment of a control method for ice making of a refrigerator in this application.

This application firstly provides a control method for ice making of a refrigerator. The inside of the refrigerator is provided with an ice maker, and the ice maker includes an ice cube tray, a water inlet device, an ice detecting rod, an ice storage box and the like, wherein the ice detecting rod is used for detecting whether the ice storage box has been full of stored ice cubes, and the bottom of the ice cube tray is further provided with a bottom temperature sensor for detecting the temperature of the ice cubes. In a first embodiment of the control method, as shown in FIG. 1, the control method for ice making based on the above-mentioned ice maker includes:

- step S10, it is detected whether the ice storage box of the ice maker is in an ice-full state under the condition that the ice maker completes ice making;
- step S20, the ice maker is controlled to perform first ice turning over under the condition of detecting that the ice storage box is not in the ice-full state;
- step S30, it is detected again whether the ice storage box of the ice maker is in the ice-full state; and
- step S40, a second time is delayed under the condition of detecting that the ice storage box is in the ice-full state, and the ice maker is controlled to restart the first ice turning-over process.

In the step S10, the ice maker is controlled to work, which is specifically that a cold air delivery pipeline of the ice maker is opened to deliver cold air generated by the running of a compressor of the refrigerator to the ice cube tray to freeze water in the ice cube tray so that the water is gradually converted into ice cubes. In order to ensure that the ice maker converts the water in the ice cube tray into the ice cubes, a basic freezing time, that is, a first time, is required. The first time described herein is determined in an early research and development test of the ice maker due to the fact that the icing completing time of different ice makers may be different according to the ice making capacity and the temperature of the cold air.

An ice detection action is performed by using the ice detecting rod of the ice maker to detect whether the ice storage box is in the ice-full state. When the ice detecting rod described herein is used for performing the ice detection action, if the ice storage box has been full of ice, at the moment, the ice detecting rod may drive a micro-switch to act, and the ice-full state may be detected by a switching signal of the micro-switch. Specifically, the ice detecting rod is linked with the rotation of the ice cube tray, that is, after ice making is completed, the ice cube tray rotates and tries to turn over ice, at the moment, the ice detecting rod is driven to rotate to the position of the ice storage box; if the ice storage box is full of ice, the ice cubes may abut against one end of the ice detecting rod so that the ice detecting rod drives the micro-switch to link; and if the ice storage box is not full of ice, one end of the ice detecting rod cannot abut against the ice cubes, and therefore, the micro-switch cannot act and is still kept in the original state. Thus, the detection whether the ice storage box is full of ice is achieved by virtue of an ice detection action of the ice detecting rod.

In the step S20, if it is detected that the ice storage box is full of ice, the ice cube tray is controlled to stop rotating and reversely rotate to return to the original position; and if it is detected that the ice storage box is not full of ice, the ice cube tray is controlled to continue to rotate until an opening of the ice cube tray faces the ice storage box arranged below the ice cube tray, and therefore, the ice cubes are poured into the ice storage box to achieve an ice turning-over action.

In the step S30 and the step S40, after the first ice turning-over action is performed by the above-mentioned control, that is, the ice cube tray reversely rotates again to an initial position where ice making is completed. At the moment, it is possible that ice cubes remain in the ice cube tray and are not completely poured into the ice storage box, and in order to ensure that the ice cubes in the ice cube tray are completely poured into the ice storage box, an ice turning-over process, that is, a second ice turning-over process, is performed again. The ice turning-over action is the same as the first ice turning-over action. When it is detected that the ice storage box is in the ice-full state, the second time is delayed. The second time can be determined according to an experience value such as a time within 0.5-3 h. Under such a condition, the ice storage box is in the ice-full state, and therefore, the ice cube tray can pour the ice cubes completing icing into the ice storage box only after a user uses a part of ice cubes. Then, the above-mentioned first ice turning-over process is restarted.

Further, the control method for ice making based on the above-mentioned ice maker further includes:

step S31, during the control of the ice maker to start a second ice turning process, if it is detected that the ice storage box is not in the ice-full state, the ice maker is controlled to complete the second ice turning process; and step S32, the ice maker is controlled to remake ice.

That is, during the start of the second ice turning-over process, if the ice storage box is not full of ice, the ice maker is controlled to complete the second ice turning-over action, and an ice making process is reentered.

According to an ice maker control method in the embodiment of this application, the ice maker is controlled to perform a process of turning over ice twice, in this way, after ice making is completed, the ice cubes in the ice cube tray can be completely poured into the ice storage box, so that the situation that ice cubes still remain in the ice cube tray is avoided after ice turning over is performed once, then, the phenomenon that the actual ice making capacity is lowered due to the residue of the ice cubes during ice making next time is avoided, and furthermore, the total ice making capacity of the ice maker is improved.

Figure 2:
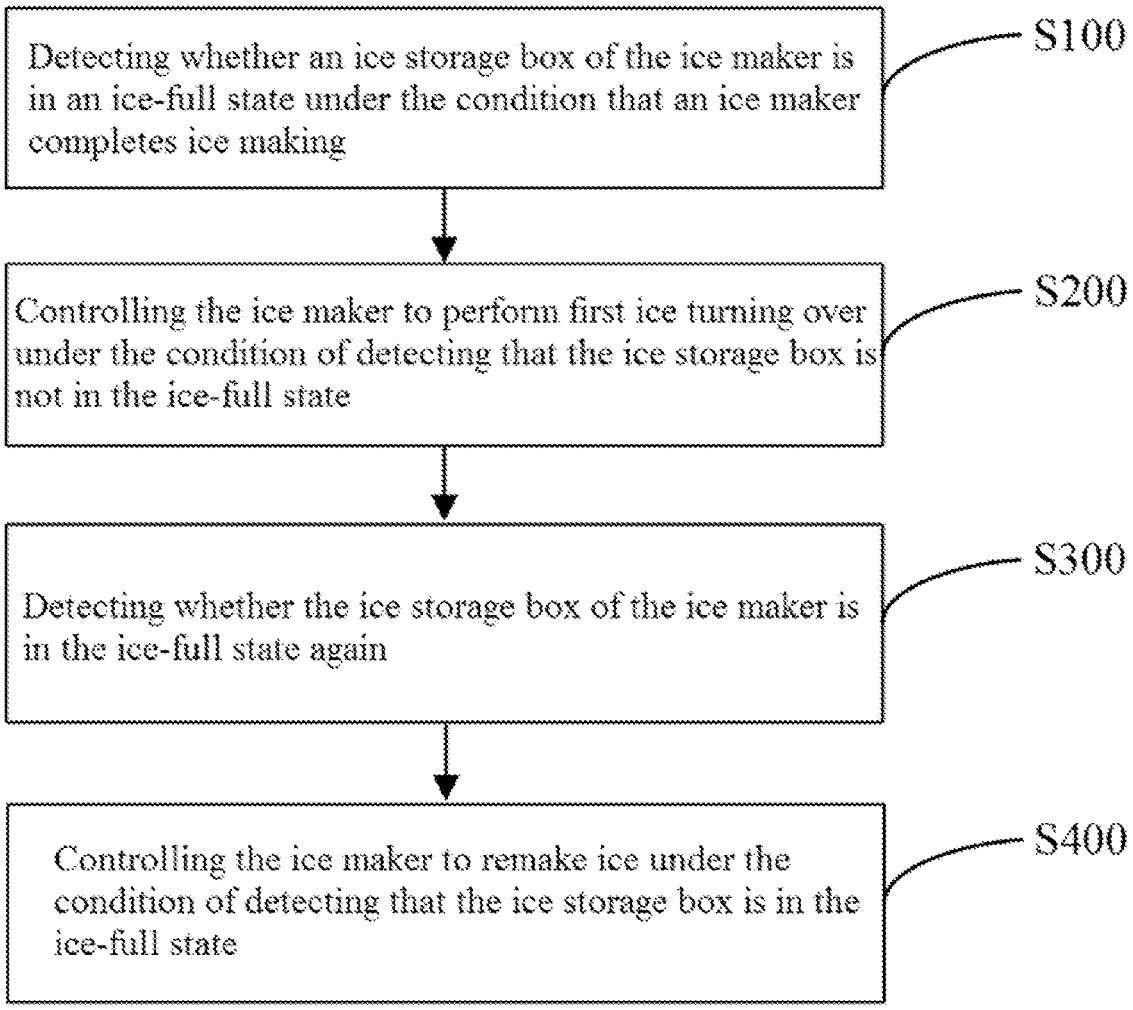
FIG. 2 is a process diagram showing a second embodiment of the control method for ice making of the refrigerator in this application.

In a second embodiment of the control method for ice making of the refrigerator in this application, an internal structure of the ice maker is the same as that in the first embodiment, as shown in FIG. 2, the control method based on the above-mentioned ice maker includes:

step S100, it is detected whether an ice storage box of the ice maker is in an ice-full state under the condition that the ice maker completes ice making;

step S200, the ice maker is controlled to perform first ice turning over under the condition of detecting that the ice storage box is not in the ice-full state;

step S300, it is detected whether the ice storage box of the ice maker is in the ice-full state again; and step S400, the ice maker is controlled to remake ice under the condition of detecting that the ice storage box is in the ice-full state.

In the step S100, the ice maker is controlled to work, which is specifically that a cold air delivery pipeline of the ice maker is opened, a compressor of the refrigerator runs on a refrigerant pipeline of the refrigerator to generate cold which forms cold air on the cold air delivery pipeline by the rotation of a fan, and the cold air is delivered to the ice cube tray by the cold air delivery pipeline, so that water in the ice cube tray is frozen to be gradually converted into ice cubes. In order to ensure that the ice maker converts the water in the ice cube tray into the ice cubes, a basic freezing time, that is, a first time, is required, the first time described herein is determined in an early research and development test of the ice maker due to the fact that the icing completing time of different ice makers may be different according to the ice making capacity and the temperature of the cold air.

A first ice detection action is performed by using the ice detecting rod of the ice maker to determine whether the ice storage box of the ice maker is full of ice cubes. When the ice detecting rod described herein is used for performing the ice detection action, if the ice storage box has been full of ice, the ice detecting rod may drive a micro-switch to act, and the ice-full state may be detected by a switching signal of the micro-switch. Specifically, the ice detecting rod is linked with the rotation of the ice cube tray, that is, after ice making is completed, the ice cube tray rotates and tries to turn over ice, at the moment, the ice detecting rod is driven to rotate to the position of the ice storage box; if the ice storage box is full of ice, the ice cubes may abut against one end of the ice detecting rod so that the ice detecting rod drives the micro-switch to link; and if the ice storage box is not full of ice, one end of the ice detecting rod cannot abut against the ice cubes, and therefore, the micro-switch cannot act and is still kept in the original state. Thus, the detection whether the ice storage box is full of ice is achieved by virtue of an ice detection action of the ice detecting rod.

In the step S200, if it is detected that the ice storage box is full of ice, the ice cube tray is controlled to stop rotating and reversely rotate to return to the original position; and if it is detected that the ice storage box is not full of ice, the ice cube tray is controlled to continue to rotate until an opening of the ice cube tray is downward to face the ice storage box arranged below the ice cube tray, and therefore, the ice cubes are poured into the ice storage box to achieve an ice turning-over action.

Further, the above-mentioned control method further includes the following steps:

a second time is delayed under the condition of firstly detecting that the ice storage box is in the ice-full state; and the ice maker is controlled to restart the first ice turning-over process.

After the ice cube tray returns to an original ice making position under the condition of firstly detecting that the ice storage box is in the ice-full state, the second time is delayed. The second time can be determined according to an experience value such as a time within 0.5-3 h. Under such a condition, the ice storage box is in the ice-full state, and therefore, the ice cube tray can pour the ice cubes completing icing into the ice storage box by turning over of the ice cube tray only after a user uses a part of ice cubes. If the user has not used ice for a long time so that the ice storage box is always in the ice-full state, for example, the second time is 1 h, the ice maker may perform the ice detection action every other one hour so as to detect whether the ice storage box is full of ice. The ice maker does not control the ice cube tray to turn over ice until the user uses a part of ice cubes so that it is detected that the ice storage box is not in the ice-full state.

After the first ice turning-over action is performed by the above-mentioned control, the ice cube tray reversely rotates to an initial position where ice making is completed. At the moment, it is possible that ice cubes remain in the ice cube tray and are not completely poured into the ice storage box, and therefore, the ice turning-over action is required to be performed again. Before the ice turning-over action is performed, similarly, the ice detecting rod is required to be firstly controlled to detect ice, that is, a second ice detection action is performed to determine whether the ice storage box is full of ice. If it is detected that the ice storage box is not full of ice, the ice turning-over action is further performed, the remaining ice cubes in the ice cube tray are completely poured into the ice storage box. After the ice turning-over action is completed, the ice maker is controlled to return to initial step S100 to restart to make ice.

In the step S300 and the step S400, if it is detected by the second ice detection action that the ice storage box is in the ice-full state, at the moment, the ice cube tray is controlled to return to an ice making position and restart to make ice. At the moment, the ice maker is directly controlled to make ice, rather than continuing to wait for the above-mentioned first time. At the moment, the ice maker certainly pours a part of ice cubes in the ice cube tray due to the first ice turning over action; or the ice cubes have been completely poured during the first ice turning over, so that there have been only parts of ice cubes or no ice cubes in the ice cube tray when the ice is detected for the second time to be full. Therefore, at the moment, the ice maker is directly controlled to make ice, in this way, the above-mentioned second time for continuing to wait is saved. The user may continue to take away a part or all of the ice cubes during ice remaking, the ice storage box is not in the ice-full state when first ice turning over is performed after ice making is completed, and then, the ice cubes may be directly poured into the ice storage box, so that the ice storage box is kept in a state of having ice cubes to be used by the user. According to the control method in the first embodiment, if it is detected by the second ice detection action that the ice storage box is full of ice, the second time is continued to be waited until it is detected that the ice storage box is not full of ice, and then, the ice maker is controlled to make ice, it is possible that the user has taken away the ice cubes when waiting for the second time, but ice making has not been completed when the user uses the ice cubes next time, and the user needs to wait for another second time at most, so that the ice making capacity of the ice maker is actually lowered, and the user experience is affected. Therefore, the control method in the present embodiment can effectively improve the ice making capacity and shorten the time that the user waits for making ice on the basis of an improved solution of the first embodiment, thereby improving the user experience.

According to the control method for ice making of the refrigerator in the embodiment of this application, it is detected whether the ice storage box of the ice maker is in the ice-full state under the condition that the ice maker completes ice making; the ice maker is controlled to complete the first ice turning-over process under the condition of detecting that the ice storage box is not in the ice-full state; it is detected whether the ice storage box of the ice maker is in the ice-full state again; and the ice maker is controlled to remake ice under the condition of detecting that the ice storage box is in the ice-full state. Compared with the control method for ice making in the first embodiment, the control method in the present embodiment can effectively increase the utilization ratio of the ice maker, improve the ice making capacity, shorten the time that the user waits for making ice, and improve the user experience.

Figure 3:
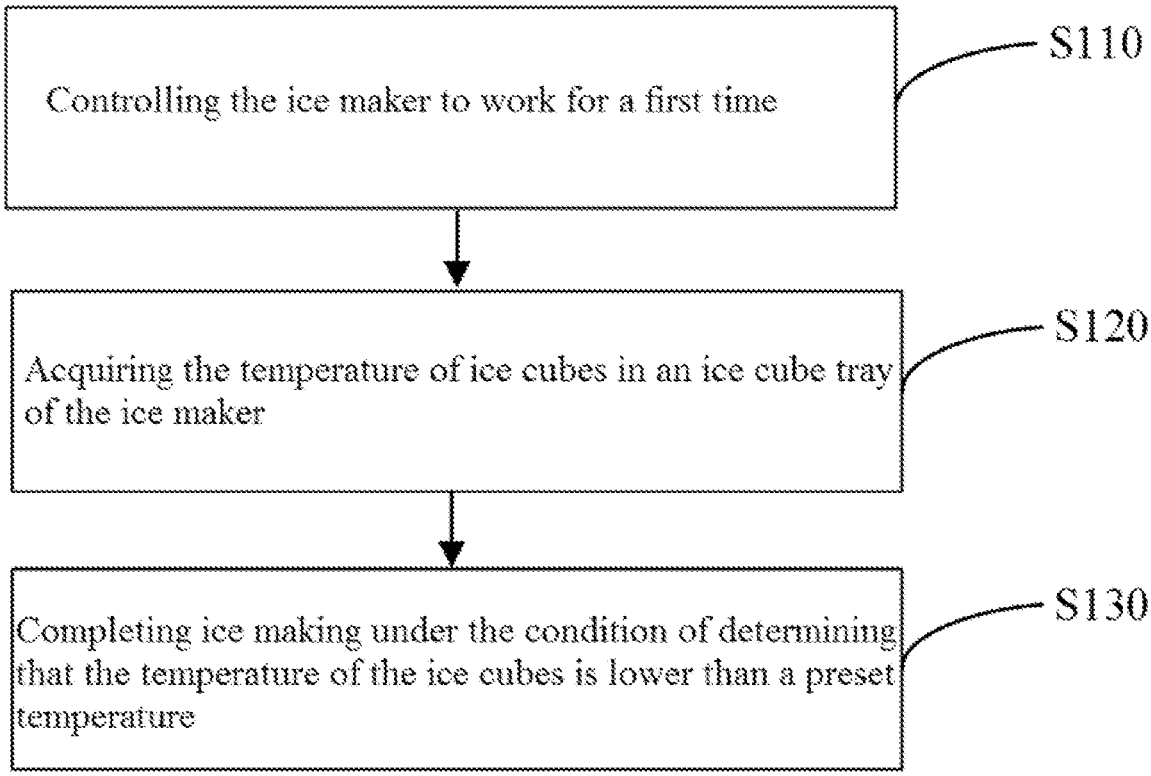
FIG. 3 is a process diagram showing a third embodiment of the control method for ice making of the refrigerator in this application.

Further, in a third embodiment of the control method, based on the first or second embodiment of the above-mentioned control method, as shown in FIG. 3, the ice maker completing ice making includes:

step S110, the ice maker is controlled to work for a first time;

step S120, the temperature of ice cubes in an ice cube tray of the ice maker is acquired; and step S130, ice making is completed under the condition of determining that the temperature of the ice cubes is lower than a preset temperature.

The present embodiment is based on the above-mentioned embodiments, when the ice maker is controlled to make ice, the ice maker is controlled to work for the first time, and in addition, a step of determining the temperature of the ice cubes in the ice cube tray is also added. The preset temperature described herein refers to a temperature for determining that icing is completed, and the preset temperature is generally determined to be −9° C. or −10° C. according to an experiment.

After the ice maker runs for the first time, it is determined whether the temperature of the ice cubes is lower than the preset temperature to ensure that the temperature inside the ice cube tray meets an icing temperature requirement so that icing is complete. If the temperature of the ice cubes is not lower than the preset temperature, the ice maker is continued to be controlled to work until the temperature of the ice cubes is lower than the preset temperature.

Figure 4:
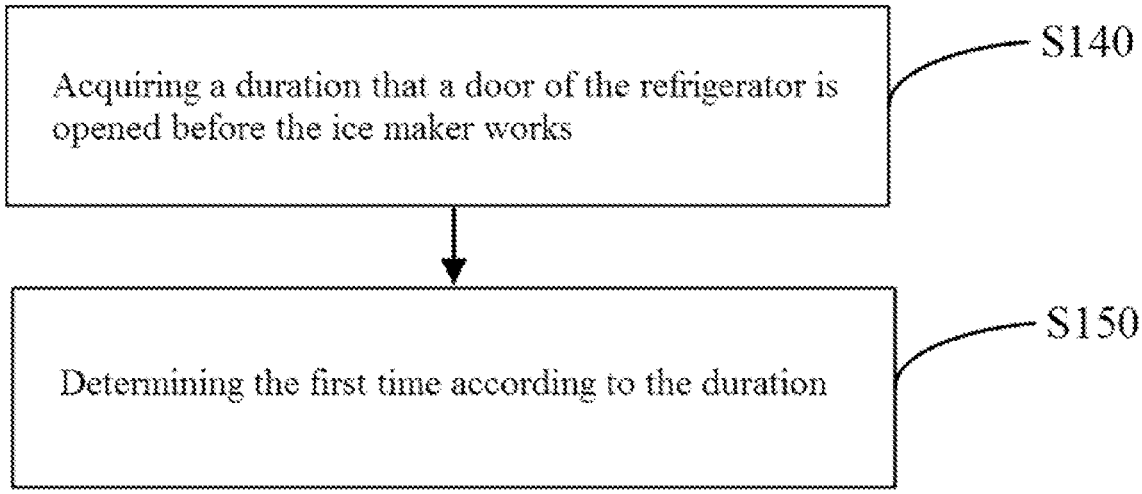
FIG. 4 is a process diagram showing a fourth embodiment of the control method for ice making of the refrigerator in this application.

Further, based on the third embodiment of the above-mentioned control method, in a fourth embodiment of the control method, as shown in FIG. 4, the above-mentioned control method further includes:

step S140, a duration that a door of the refrigerator is opened before the ice maker works is acquired; and step S150, the first time is determined according to the duration.

The duration that the door is opened herein refers to a time between opening and closing of a door of a freezing chamber or a refrigerating chamber of the refrigerator. By taking a situation that the ice maker is arranged in the freezing chamber as an example, the ice maker is installed in the freezing chamber of the refrigerator, when the door of the freezing chamber has been opened before ice making, heat in an ambient environment of the refrigerator may be transferred to the freezing chamber to raise the temperature in the freezing chamber, thereby affecting the ice making speed of the ice maker. Therefore, the duration that the door of the freezing chamber is opened is required to be detected before ice making so that the above-mentioned first time for ice making is determined.

Specifically, in one implementation, when the door opening time is acquired, a duration that the door of the freezing chamber is opened last time may be acquired, for example, the duration that the door is opened last time is 30 s which is used as the duration that the door is opened.

Or, in another implementation, the above-mentioned step that the duration that the door is opened is acquired includes the following steps:

step S141, single times that the door of the refrigerator is opened are recorded within a third time before the ice maker works; and step S142, the duration is determined according to the single times.

That is, the single times that the door of the refrigerator is opened are recorded within the third time such as 1 h. For example, it is recorded that the door is opened for five times within 1 h, the durations that the door is opened are respectively 30 s, 20 s, 40 s, 80 s and 60 s from the latest to the earliest, and thus, the duration that the door is opened is determined according to the five single times recorded as above. When the duration that the door is opened is specifically determined, an averaging method or a computational formula which is combined with computing coefficients and is specifically expressed as T=T*K1+T2*K2+T3*K3+T4*K4+T5*K5 may be adopted, wherein T1 to T5 are sequentially the durations that the door is opened for five times from the latest to the earliest, K1 to K5 are the corresponding computing coefficients, and K1≥K2≥K3≥K4≥K5, for example, K1 to K5 are sequentially 0.45, 0.25, 0.15, 0.1 and 0.05, and the sum of the computing coefficients is 1. In a computing method in which the different computing coefficients are adopted, the principle that the latest door opening time has the greatest effects on the temperature in the ice maker is taken into account, so that the computed duration that the door is opened is reasonable.

Further, based on the above-mentioned implementations, the above-mentioned step that the duration that the door is opened is acquired further includes the following steps:

step S143, single interval times between the single times that the door of the refrigerator is opened are recorded; and step S144, the duration is determined according to the single interval times and the single times.

In the above-mentioned steps, the single times that the door of the refrigerator is opened are recorded in the step S141, and in addition, the single interval times between the single times are further recorded. For example, the interval times between the single times that the door is opened for five times from the latest to the earliest are sequentially 20 s, 40 s, 30 s and 69 s, wherein the latest time refers to the interval time closest to the ice making work, and the computing coefficients are regulated according to the above-mentioned different interval times. For example, the above-mentioned corresponding computing coefficients K1 to K5 may be regulated to be 0.5, 0.25, 0.15, 0.075 and 0.025. The longer the interval time and the time of waiting for making ice are, the lower the effects on the temperature of the freezing chamber and the duration are, and therefore, the more accurate duration can be finally obtained.

Figure 5:
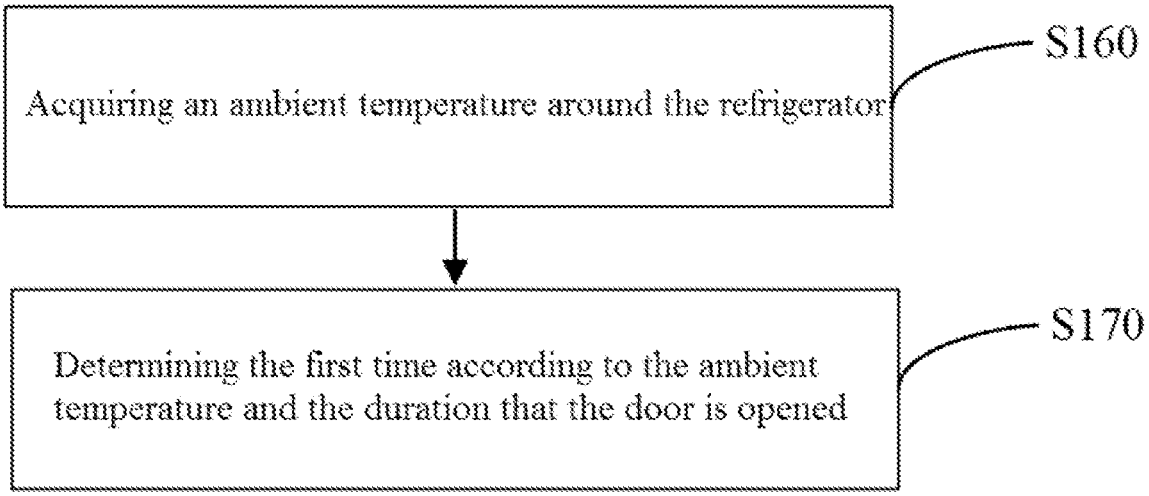
FIG. 5 is a process diagram showing a fifth embodiment of the control method for ice making of the refrigerator in this application.

Further, based on the fourth embodiment of the control method, in a fifth embodiment of the control method, as shown in FIG. 5, the above-mentioned control method further includes:

step S160, an ambient temperature around the refrigerator is acquired; and step S170, the first time is determined according to the ambient temperature and the duration that the door is opened.

In this embodiment, when the first time is determined, a parameter of the ambient temperature around the refrigerator is further added. Specifically, the ambient temperature may be detected by an ambient temperature sensor arranged on the refrigerator. Of course, the ambient temperature may also be detected based on a temperature sensor on other wireless communication devices such as a mobile phone and an air conditioner arranged in the same region and is transmitted to the refrigerator in a wireless communication mode, which is easily realized on a household appliance based on internet of things at present. Since the ambient temperature also affects a corresponding external ambient temperature heat transferred to the freezing chamber, when the door of the freezing chamber is opened, the higher the external ambient temperature is, the more the heat transferred to the freezing chamber is during the period that the door of the freezing chamber is opened. Therefore, the first time which is collectively determined by the ambient temperature and the duration that the door is opened is more accurate.

Figure 6:
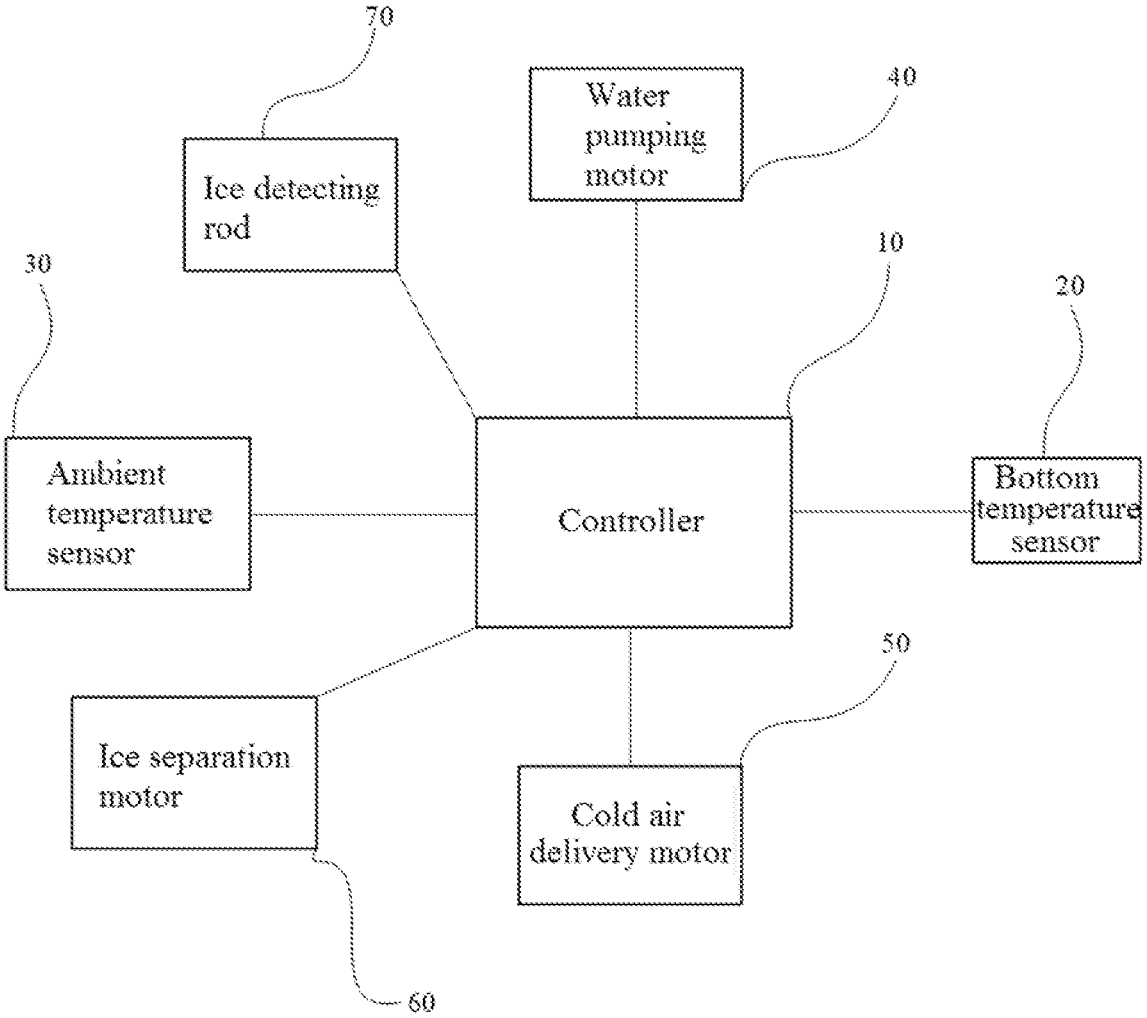
FIG. 6 is a block diagram showing a control device for ice making of a refrigerator in this application.

This application further provides a control device for ice making of a refrigerator. The inside of the refrigerator is provided with an ice maker which is generally arranged in a freezing chamber of the refrigerator, and the ice maker includes an ice cube tray, a water inlet device, an ice storage box and the like. In a first embodiment of the control device, as shown in FIG. 6, the control device includes:

an ice detecting rod 70, configured to detect whether the ice storage box of the ice maker is full of ice; and a controller 10, configured to detect whether the ice storage box of the ice maker is in an ice-full state under the condition that the ice maker completes ice making; control the ice maker to perform first ice turning over under the condition of detecting that the ice storage box is not in the ice-full state; detect again whether the ice storage box of the ice maker is in the ice-full state; and control the ice maker to remake ice under the condition of detecting that the ice storage box is in the ice-full state.

The above-mentioned control device may further include a water pumping motor 40, a cold air delivery motor 50 and an ice separation motor 60, wherein the water pumping motor 40 is configured to deliver water to the ice cube tray of the ice maker; the cold air delivery motor 50 is configured to generate a circulating air flow by running during ice making and deliver cold air to the ice cube tray through a cold air delivery channel, and specifically, the cold air delivery motor 50 drives a fan to deliver the cold air to the ice cube tray; and the ice separation motor 60 is configured to drive the ice cube tray to rotate so as to perform an ice detection action and an ice turning-over action.

The ice maker is controlled to work, which is specifically that a cold air delivery pipeline of the ice maker is opened, a compressor of the refrigerator runs to generate cold on a refrigerant pipeline of the refrigerator, the fan rotates to form cold air in the cold air delivery pipeline, and the cold air is delivered to the ice cube tray through the cold air delivery pipeline to freeze water in the ice cube tray so that the water is gradually converted into ice cubes. In order to ensure that the ice maker converts the water in the ice cube tray into the ice cubes, a basic freezing time, that is, a first time, is required. The first time described herein is determined in an early research and development test of the ice maker due to the fact that the icing completing time of different ice makers may be different according to the ice making capacity and the temperature of the cold air.

A first ice detection action is performed by using the ice detecting rod 70 of the ice maker to determine whether the ice storage box of the ice maker is full of ice cubes. When the ice detecting rod 70 described herein is used for performing the ice detection action, if the ice storage box has been full of ice, the ice detecting rod 70 may drive a micro-switch to act, and the ice-full state may be detected by a switching signal of the micro-switch. Specifically, the ice detecting rod 70 is linked with the rotation of the ice cube tray, that is, after ice making is completed, the ice separation motor 60 is controlled to run to drive the ice cube tray to rotate and try to turn over ice, at the moment, the ice detecting rod 70 is driven to rotate to the position of the ice storage box; if the ice storage box is full of ice, the ice cubes may abut against one end of the ice detecting rod 70 so that the ice detecting rod 70 drives the micro-switch to act; and if the ice storage box is not full of ice, one end of the ice detecting rod 70 cannot abut against the ice cubes, and therefore, the micro-switch cannot act and is still kept in the original state. Thus, the detection whether the ice storage box is full of ice is achieved by virtue of an ice detection action of the ice detecting rod 70.

If it is detected that the ice storage box is full of ice, the ice cube tray is controlled to stop rotating and reversely rotate to return to the original position; and if it is detected that the ice storage box is not full of ice, the ice cube tray is controlled to continue to rotate until an opening of the ice cube tray is downward to face the ice storage box arranged below the ice cube tray, and therefore, the ice cubes are poured into the ice storage box to achieve an ice turning-over action.

Further, when the above-mentioned ice-full state is detected, the controller 10 is further configured to: delay a second time under the condition of firstly detecting that the ice storage box is in the ice-full state; and control the ice maker to restart the first ice turning-over process.

After the ice cube tray returns to an original ice making position under the condition of firstly detecting that the ice storage box is in the ice-full state, the second time is delayed. The second time can be determined according to an experience value such as a time within 0.5-3 h. Under such a condition, the ice storage box is in the ice-full state, and therefore, the ice cube tray can pour the ice cubes completing icing into the ice storage box by turning over of the ice cube tray only after a user uses a part of ice cubes. If the user has not used ice for a long time so that the ice storage box is always in the ice-full state, for example, the second time is 1 h, the ice maker may perform the ice detection action every other one hour so as to detect whether the ice storage box is full of ice. The ice maker does not control the ice cube tray to turn over ice until the user uses a part of ice cubes so that it is detected that the ice storage box is not in the ice-full state.

After the first ice turning-over action is performed by the above-mentioned control, the ice cube tray reversely rotates to an initial position where ice making is completed. At the moment, it is possible that ice cubes remain in the ice cube tray and are not completely poured into the ice storage box, and therefore, the ice turning-over action is required to be performed again. Before the ice turning-over action is performed, similarly, the ice detecting rod 70 is required to be firstly controlled to detect ice, that is, a second ice detection action is performed to determine whether the ice storage box is full of ice. If it is detected that the ice storage box is not full of ice, the ice turning-over action is further performed, the remaining ice cubes in the ice cube tray are completely poured into the ice storage box. After the ice turning-over action is completed, the ice maker is controlled to return to the step that ice making starts to restart to make ice.

If it is detected by the second ice detection action that the ice storage box is in the ice-full state, at the moment, the ice cube tray is controlled to return to an ice making position and restart to make ice. At the moment, the ice maker is directly controlled to make ice, rather than continuing to wait for the above-mentioned first time. At the moment, the ice maker certainly pours a part of ice cubes in the ice cube tray due to the first ice turning-over action; or the ice cubes have been completely poured during the first ice turning over, so that there have been only parts of ice cubes or no ice cubes in the ice cube tray when the ice is detected for the second time to be full. Therefore, at the moment, the ice maker is directly controlled to make ice, in this way, the above-time second time for continuing to wait is saved. The user may continue to take away a part or all of the ice cubes during ice remaking, the ice storage box is not in the ice-full state when the first ice turning over is performed after ice making is completed, and then, the ice cubes may be directly poured into the ice storage box, so that the ice storage box is kept in a state of having ice cubes to be used by the user. According to the control device in the first embodiment, if it is detected by the second ice detection action that the ice storage box is full of ice, the second time is continued to be waited until it is detected that the ice storage box is not full of ice, and then, the ice maker is controlled to make ice, it is possible that the user has taken away the ice cubes when waiting for the second time, but ice making has not been completed when the user uses the ice cubes next time, and the user needs to wait for another second time at most, so that the ice making capacity of the ice maker is actually lowered, and the user experience is affected. Therefore, the control device in the present embodiment can effectively improve the ice making capacity and shorten the time that the user waits for making ice on the basis of an improved solution of the first embodiment, thereby improving the user experience.

According to the control device for ice making of the refrigerator in the embodiment of this application, the controller controls the ice maker to work for the first time to complete ice making, then, controls the ice detecting rod 70 of the ice maker to perform the first ice detection action to determine whether the ice storage box of the ice maker is full of ice, controls the ice maker to perform the ice turning-over action under the condition of determining that the ice storage box is not full of ice, continues to control the ice detecting rod 70 to perform the second ice detection action to determine whether the ice storage box is full of ice, and controls the ice maker to work to remake ice under the condition of determining that the ice storage box is full of ice. Compared with an existing control device for ice making, the control device can effectively increase the utilization ratio of the ice maker, improve the ice making capacity, shorten the time that the user waits for making ice, and improve the user experience.

Further, in a second embodiment of the control device, the control device further includes a bottom temperature sensor 20 installed at the bottom of the ice cube tray and configured to detect the temperature of ice cubes in the ice cube tray of the ice maker; and after controlling the ice maker to work for the first time, the controller 10 is further configured to: receive the detected temperature of the ice cubes from the bottom temperature sensor 20; and complete ice making when determining that the temperature of the ice cubes is lower than a preset temperature.

The present embodiment is based on the above-mentioned embodiment, when the ice maker is controlled to make ice, the ice maker is controlled to work for the first time, and in addition, a step of determining the temperature of the ice cubes in the ice cube tray is also added. The preset temperature described herein refers to a temperature for determining that icing is completed, and the preset temperature is generally determined to be −9° C. or −10° C. according to an experiment.

After the ice maker runs for the first time, it is determined whether the temperature of the ice cubes is lower than the preset temperature to ensure that the temperature inside the ice cube tray meets an icing temperature requirement so that icing is complete. If the temperature of the ice cubes is not lower than the preset temperature, the ice maker is continued to be controlled to work until the temperature of the ice cubes is lower than the preset temperature.

Further, based on the second embodiment of the above-mentioned control device, in a third embodiment of the control device, the controller 10 is further configured to: acquire a duration that a door of a freezing chamber is opened before the ice maker works; and determine the first time according to the duration.

The duration that the door is opened herein refers to a time between opening and closing of a door of a freezing chamber or a refrigerating chamber of the refrigerator. By taking a situation that the ice maker is arranged in the freezing chamber as an example, the ice maker is installed in the freezing chamber of the refrigerator, when the door of the freezing chamber has been opened before ice making, heat in an ambient environment of the refrigerator may be transferred to the freezing chamber to raise the temperature in the freezing chamber, thereby affecting the ice making speed of the ice maker. Therefore, the duration that the door of the freezing chamber is opened is required to be detected before ice making so that the above-mentioned first time for ice making is determined.

Specifically, in one implementation, when the door opening time is acquired, a duration that the door of the freezing chamber is opened last time may be acquired, for example, the duration that the door is opened last time is 30 s which is used as the duration that the door is opened.

Or, in another implementation, when the above-mentioned duration that the door is opened is acquired, the controller 10 is configured to: record single times that the door of the refrigerator is opened within a third time before the ice maker works; and determine the duration according to the single times.

That is, the single times that the door of the refrigerator is opened are recorded within the third time such as 1 h. For example, it is recorded that the door is opened for five times within 1 h, the durations that the door is opened are respectively 30 s, 20 s, 40 s, 80 s and 60 s from the latest to the earliest, and thus, the duration that the door is opened is determined according to the five single times recorded as above. When the duration that the door is opened is specifically determined, an averaging method or a computational formula which is combined with computing coefficients and is specifically expressed as $T=T*K1+T2*K2+T3*K3+T4*K4+T5*K5$ may be adopted, wherein T1 to T5 are sequentially the durations that the door is opened for five times from the latest to the earliest, K1 to K5 are the corresponding computing coefficients, and $K1 \geq K2 \geq K3 \geq K4 \geq K5$, for example, K1 to K5 are sequentially 0.45, 0.25, 0.15, 0.1 and 0.05, and the sum of the computing coefficients is 1. In a computing method in which the different computing coefficients are adopted, the principle that the latest door opening time has the greatest effects on the temperature in the ice maker is taken into account, so that the computed duration that the door is opened is reasonable.

Further, based on the above-mentioned implementations, when the above-mentioned duration that the door is opened is acquired, the controller 10 is further configured to: record single interval times between the single times that the door of the refrigerator is opened; and determine the duration according to the single interval times and the single times.

In the above-mentioned control processes, the single times that the door of the refrigerator is opened are recorded, in addition, the single interval times between the single times are further recorded. For example, the interval times between the single times that the door is opened for five times from the latest to the earliest are sequentially 20 s, 40 s, 30 s and 69 s, wherein the latest time refers to the interval time closest to the ice making work, and the computing coefficients are regulated according to the above-mentioned different interval times. For example, the above-mentioned corresponding computing coefficients K1 to K5 may be regulated to be 0.5, 0.25, 0.15, 0.075 and 0.025. The longer the interval time and the time of waiting for making ice are, the lower the effects on the temperature of the freezing chamber and the duration are, and therefore, the more accurate duration can be finally obtained.

Further, based on the third embodiment of the control device, in a fourth embodiment of the control device, the control device further includes an ambient temperature sensor 30 configured to detect an ambient temperature around the refrigerator. The controller 10 is further configured to: read the ambient temperature around the refrigerator from the ambient temperature sensor 30; and determine the first time according to the ambient temperature and the duration.

In this embodiment, when the first time is determined, a parameter of the ambient temperature around the refrigerator is further added. Specifically, the ambient temperature may be detected by the ambient temperature sensor 30 arranged on the refrigerator. Of course, the ambient temperature may also be detected based on a temperature sensor on other wireless communication devices such as a mobile phone and an air conditioner arranged in the same region and is transmitted to the refrigerator in a wireless communication mode, which is easily realized on a household appliance based on internet of things at present. Since the ambient temperature also affects a corresponding external ambient temperature heat transferred to the freezing chamber, when the door of the freezing chamber is opened, the higher the external ambient temperature is, the more the heat transferred to the freezing chamber is during the period that the door of the freezing chamber is opened. Therefore, the first time which is collectively determined by the ambient temperature and the duration that the door is opened is more accurate.

This application further provides a refrigerator having an ice making function. The refrigerator includes the above-mentioned control device for ice making of the refrigerator. By using the control device, the utilization ratio of an ice maker can be effectively increased, and the ice making capacity can be improved, so that the time that a user waits for making ice can be shortened, and the user experience can be improved.

An implementation of this application further provides a computer program product including a program instruction. When the program instruction is executed by a controller, the controller can implement the control method for ice making of the refrigerator in any one of the above-mentioned embodiments.

An implementation of this application further provides a storage medium storing a computer readable instruction. When the computer readable instruction is executed by a controller, the controller can implement the control method for ice making of the refrigerator in any one of the above-mentioned embodiments.

It can be understood by those skilled in the art that all or parts of steps of the methods in the above-mentioned implementations can be completed by a program instructing relevant hardware. The program is stored in a storage medium and includes a plurality of instructions for enabling one (which may be a single chip microcomputer, a chip and the like) or a processor to perform all or parts of the steps of the method in each of the implementations of this application. The above-mentioned storage medium includes various media, such as a USB flash drive, a mobile hard disk, an ROM (Read-Only Memory), an RAM (Random Access Memory), a disk or an optical disk, capable of storing program codes.

In addition, various different implementations in the implementations of this application can also be arbitrarily combined, and they should be also regarded as contents disclosed by the implementations of this application as long as they do not depart from the idea of the implementations of this application.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A control method for ice making of a refrigerator, the refrigerator comprising an ice maker, comprising:

acquiring a duration that a door of the refrigerator is opened before the ice maker works; and determining a first time according to the duration;

controlling the ice maker to work for a first time;

acquiring a temperature of ice cubes in an ice cube tray of the ice maker; and completing ice making in response to determining that the temperature of the ice cubes is lower than a preset temperature;

detecting whether an ice storage box of the ice maker is in an ice-full state in response to that the ice maker completes ice making;

controlling the ice maker to perform a first ice turning over in response to detecting that the ice storage box is not in the ice-full state;

detecting again whether the ice storage box of the ice maker is in the ice-full state; and controlling the ice maker to remake ice in response to detecting that the ice storage box is in the ice-full state.

2. Control method of claim 1, wherein the detecting again whether the ice storage box of the ice maker is in the ice-full state further comprises:

controlling the ice maker to perform a second ice turning over in response to detecting that the ice storage box is not in the ice-full state; and controlling the ice maker to remake ice.

3. The control method of claim 1, further comprising:

delaying a second time in response to firstly detecting that the ice storage box is in the ice-full state; and controlling the ice maker to restart first ice turning over.

4. The control method of claim 1, further comprising:

acquiring an ambient temperature around the refrigerator; and determining the first time according to the ambient temperature and the duration.

5. A control device for ice making of a refrigerator, the refrigerator including an ice maker, and the control device comprising:

a controller configured to acquire a duration that a door of the refrigerator is opened before the ice maker works; and determine a first time according to the duration;

control the ice maker to work for a first time;

acquire a temperature of ice cubes in an ice cube tray of the ice maker; and complete ice making in response to determining that the temperature of the ice cubes is lower than a preset temperature;

detect whether an ice storage box of the ice maker is in an ice-full state in response to that the ice maker completes ice making;

control the ice maker to perform a first ice turning over in response to detecting that the ice storage box is not in the ice-full state;

detect again whether the ice storage box of the ice maker is in the ice-full state; and control the ice maker to remake ice in response to detecting that the ice storage box is in the ice-full state.

6. The control device of claim 5, wherein the controller is further configured to:

control the ice maker to perform a second ice turning over in response to detecting that the ice storage box is not in the ice-full state; and control the ice maker to remake ice.

7. The control device of claim 5, the controller is further configured to:

delay a second time in response to firstly detecting that the ice storage box is in the ice-full state; and control the ice maker to restart first ice turning over.

8. The control device of claim 5, wherein the controller is further configured to:

acquire an ambient temperature around the refrigerator; and determine the first time according to the ambient temperature and the duration.

9. A refrigerator, comprising:

an ice maker including an ice storage box; and a controller, the controller configured to:

acquire a duration that a door of the refrigerator is opened before the ice maker works; and determine a first time according to the duration;

control the ice maker to work for a first time;

acquire a temperature of ice cubes in an ice cube tray of the ice maker; and complete ice making in response to determining that the temperature of the ice cubes is lower than a preset temperature;

detect whether the ice storage box of the ice maker is in an ice-full state in response to that the ice maker completes ice making;

control the ice maker to perform a first ice turning over in response to detecting that the ice storage box is not in the ice-full state;

detect again whether the ice storage box of the ice maker is in the ice-full state; and control the ice maker to remake ice in response to detecting that the ice storage box is in the ice-full state.

10. The refrigerator of claim 9, wherein the controller is further configured to:

control the ice maker to perform a second ice turning over in response to detecting that the ice storage box is not in the ice-full state; and control the ice maker to remake ice.

11. The refrigerator of claim 9, wherein the controller is further configured to:

delay a second time in response to firstly detecting that the ice storage box is in the ice-full state; and control the ice maker to restart first ice turning over.

12. The refrigerator of claim 9, wherein the controller is further configured to:

acquire an ambient temperature around the refrigerator; and determine the first time according to the ambient temperature and the duration.

* * * * *